United States Patent [19]

Thomas et al.

[11] 3,983,803

[45] Oct. 5, 1976

[54] AUTOMATIC PRINT GAP ADJUSTMENT ARRANGEMENT

[75] Inventors: Roy D. Thomas, Wenonah, N.J.; Ross W. Johnston, Norristown, Pa.

[73] Assignee: Sperry Rand Corporation, New York, N.Y.

[22] Filed: Sept. 16, 1974

[21] Appl. No.: 506,071

Related U.S. Application Data

[63] Continuation of Ser. No. 401,524, Sept. 27, 1973, abandoned.

[52] U.S. Cl. ..... 101/93.03; 101/111; 197/149; 101/426

[51] Int. Cl.[2] ..... B41J 7/92

[58] Field of Search..... 101/93, 111, 426, 407 BP, 101/407 R, 93.03; 197/126, 127, 133, 149

[56] References Cited

UNITED STATES PATENTS

| | | | |
|---|---|---|---|
| 3,155,032 | 11/1964 | Antonucci | 101/45 |
| 3,277,822 | 10/1966 | Marl et al. | 101/269 |
| 3,418,928 | 12/1968 | Donzano | 101/93 |
| 3,442,210 | 5/1969 | Hawxhurst | 101/407 BP |
| 3,730,082 | 5/1973 | Perry | 101/93 C |
| 3,742,848 | 7/1973 | Huntoon | 101/93 C |
| 3,750,792 | 8/1973 | Liles | 197/1 R |
| 3,756,151 | 9/1973 | Zofchak | 101/269 |
| 3,780,648 | 12/1973 | Curtiss et al. | 101/93 C |

OTHER PUBLICATIONS

*IBM Technical Disclosure Bulletin*, vol. 13, No. 12, May 1971, p. 3643, Carpenter et al.

*Primary Examiner*—Edward M. Coven
*Attorney, Agent, or Firm*—Rene A. Kuypers

[57] ABSTRACT

A mechanism is disclosed for automatically positioning the print mechanism with respect to the forms and ribbon in a printer assembly. The automatic adjustment takes place for varying thicknesses of the forms, which is a function of the number of copies being printed and the type of form, as well as the variations in the thickness of the ribbon. The above-mentioned adjustment takes place after there has been a simulation of the print hammer striking the paper which may be a single-part or multi-part form.

6 Claims, 5 Drawing Figures

RETRACTED POSITION

EXTENDED POSITION

AUTOMATIC PRINT GAP ADJUSTMENT ARRANGEMENT

This is a continuation, of application Ser. NO. 401,524, filed Sept. 27, 1973 now abandoned.

BACKGROUND OF THE INVENTION

1. Field of the Invention

This invention relates to the field of printer devices. In particular, the invention relates to the field of printers utilized as the output of the computer as well as to the field of print registration for such a printer.

2. Description of the Prior Art

Record is made of a known automatic print gap adjusting mechanism utilized with the IBM 3211 printer. Known prior art patents made of record in this application are U.S. Pat. Nos. 2,993,437, 3,049,990 and 3,183,830. These patents are cited as being of interest since they relate to the art of print registration.

Previously known designs of printer gap adjusting mechanisms utilized with conventional impact printers have required operator intervention. Accordingly, it has been the practice in these known printer arrangements to require manual adjustments to compensate for varying forms and ribbon thicknesses. Manual adjusting of the print gap has not been entirely satisfactory for the fact that it is a time consuming operation and further for the fact that the operator may forget to make such necessary manual adjustments after inserting new forms or ribbon. When there is a failure to obtain a proper print gap clearance, the possibility of paper jams, character edge clipping and improper print registration becomes proximate. Therefore, it is with these shortcomings in mind that the instant automatic adjustment technique has been designed.

SUMMARY OF THE INVENTION

The invention discloses an "on the fly" printer which utilizes a closed loop servo mechanism which provides an automatic adjustment of the print band with respect to the print hammer. The technique comprises initially making a measurement of both the ribbon and the form thickness which are variable. The above measurement is made from a sub-carriage assembly which includes the print band and further includes a probe which is extended against the forms pack under spring pressure. The shape of the end of the probe and spring are formed to simulate the actual printing operation. Upon completion of the above mentioned measurement, the sub-carriage is repositioned with respect to the fixed print head until a desired position is obtained. The desired separation between the print hammer and print band is achieved when a null position is developed by the servomechanism. The null position varies in accordance with the thickness of the forms and ribbon.

DESCRIPTION OF THE PREFERRED EMBODIMENT

Figure 1:
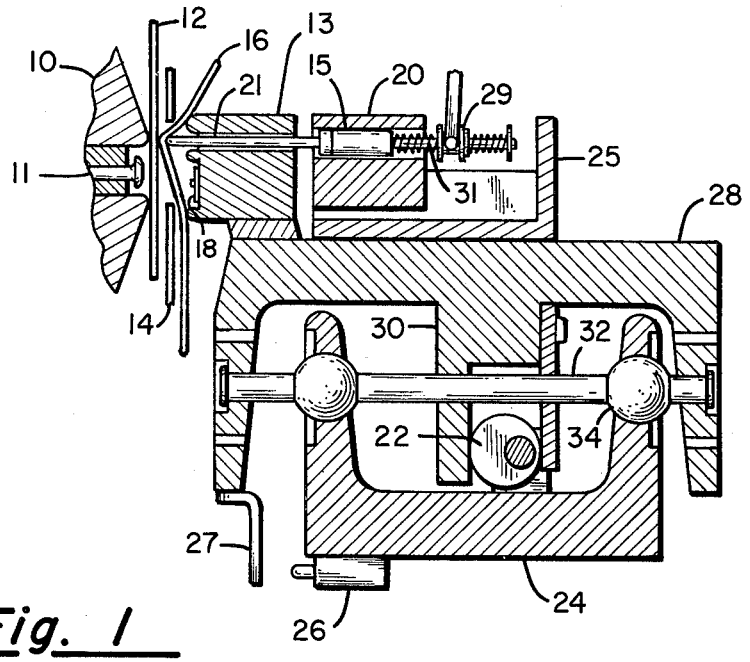
FIG. 1 depicts a mechanical arrangement for developing automatic gap positioning for the printer mechanism utilized in this invention.

FIG. 1 discloses a printer device assembly which is utilized as the output of a digital computer. The printer assembly disclosed operates in accordance with well-known "on the fly" printing principles. With this type of operation, a plurality of uniformly spaced engraved type members (not shown) are attached to a continuous belt 18. Suitable drive means such as a constant speed electric motor (not shown) including drive gears are provided to advance the print band in a continuous horizontal path and along a print line. A plurality of hammers such as 11 associated with an assembly known as a print head 10 are arranged in a horizontal fashion and opposite the print band. Each print hammer is associated with a solenoid which when energized causes the print hammer to strike the appropriate letter on the print band 18. Interposed between the print hammer 11 and the print band 18 is the forms pack 12, the ribbon shield 14 and the ribbon 16. The forms pack 12 comprises the paper forms upon which printing is to be performed. It should be noted hereat that the forms pack 12 and the ribbon 16 may have a varying thickness depending upon the type of paper and ribbon used or the number of carbon copies required. Therefore, as can be readily appreciated, when the hammer 11 is actuated by the solenoid against the print band 18 a character will be printed on the forms of the pack 12 in view of the interposed ribbon 16.

The print band 18 and its associated assembly is attached to the sub-carriage 28. Also the probe assembly 20 is permanently attached to the sub-carriage 28 via the L shaped bracket 25. The probe assembly 20 comprises essentially a linear variable differential transformer (LVDT). As is well known in the art, an LVDT is a transformer arrangement having both secondary and primary windings wherein the core 15 is moveable in a linear fashion between the primary and the secondary winding. The windings of the LVDT are permanently positioned in the probe assembly housing 20 which is in turn permanently positioned to the sub-carriage 28 via the L shaped bracket 25. Attached to the LVDT core 15 is a probe 21. The probe via the core 15 of the LVDT can be extended by means of a motor (not shown) which is connected to the arm 29 by means of a linkage 88 (FIG. 4). As depicted in FIGS. 1 and 4, the probe 21 is extended against the ribbon 16 and through the ribbon shield 14 until it touches and presses against the forms pack 12 via the arm 29 and the compression spring 31. When the paper pack 12 is contacted by the probe, the latter stops but the motor continues to compress the spring 31 until correct spring pressure is obtained. In other words, the motor will compress the spring 31 until it contacts an adjustable limit switch 90 and this action will constitute the correct spring pressure. The shape at the end of the probe 21 is formed together with the spring 31 to simulate the actual printing operation as will be discussed in greater detail in FIG. 4.

Positioned below the sub-carriage 28 is the main carriage 24. An eccentric 22 is located upon a vertical projection of the main carriage 24 such that its periphery is contiguous to the eccentric follower 30. The follower 30 is connected to the sub-carriage 28 and slides horizontally on the sub-carriage guide shafts 32. The sub-carriage 28 is fixed at its outermost points to the extremities of the guide shafts 32, which are arranged to slide within the self-aligning spherical bearings 34. The bearings 34 which are positioned at the outer most points of the main carriage 24, have sleeves which are adapted to receive the guide shafts 32.

Summarizing the operation, the probe 21 is made to extend towards the forms pack 12 from the fully retracted position. After the probe 21 is extended, the eccentric 22 is then revolved in such a manner that it causes the sub-carriage 28 via the eccentric follower 30 to move towards the print head 10. This action of the eccentric 22 further causes the windings of the LVTD assembly 20 to also advance toward the print head 10. The windings are advanced until they align with the core 15 of the LVTD. When alignment is achieved, a null condition in the LVDT is developed and the eccentric motion is stopped. The correct distance between the print head 10 and the print band 13 is thereby produced. The probe 21 is then retracted and the automatic gap adjust cycle is completed.

Whenever the sub-carriage 28 and the main carriage 24 are opened (i.e., pivoted away from the print head) for any reason, the assumption is made that the forms pack 12 or the ribbon 16 has been changed. Accordingly, when the carriage is opened, the eccentric 22 rotates in the reverse direction so that the main carriage 24 and the sub-carriage including the probe 28 are translated to the furtherest distance from the print head 10. The motion of the eccentric is then stopped and the cycle above described begins again when the carriage is closed. This cycle is also performed when the carriage power is initially applied to the machine.

Figure 2:
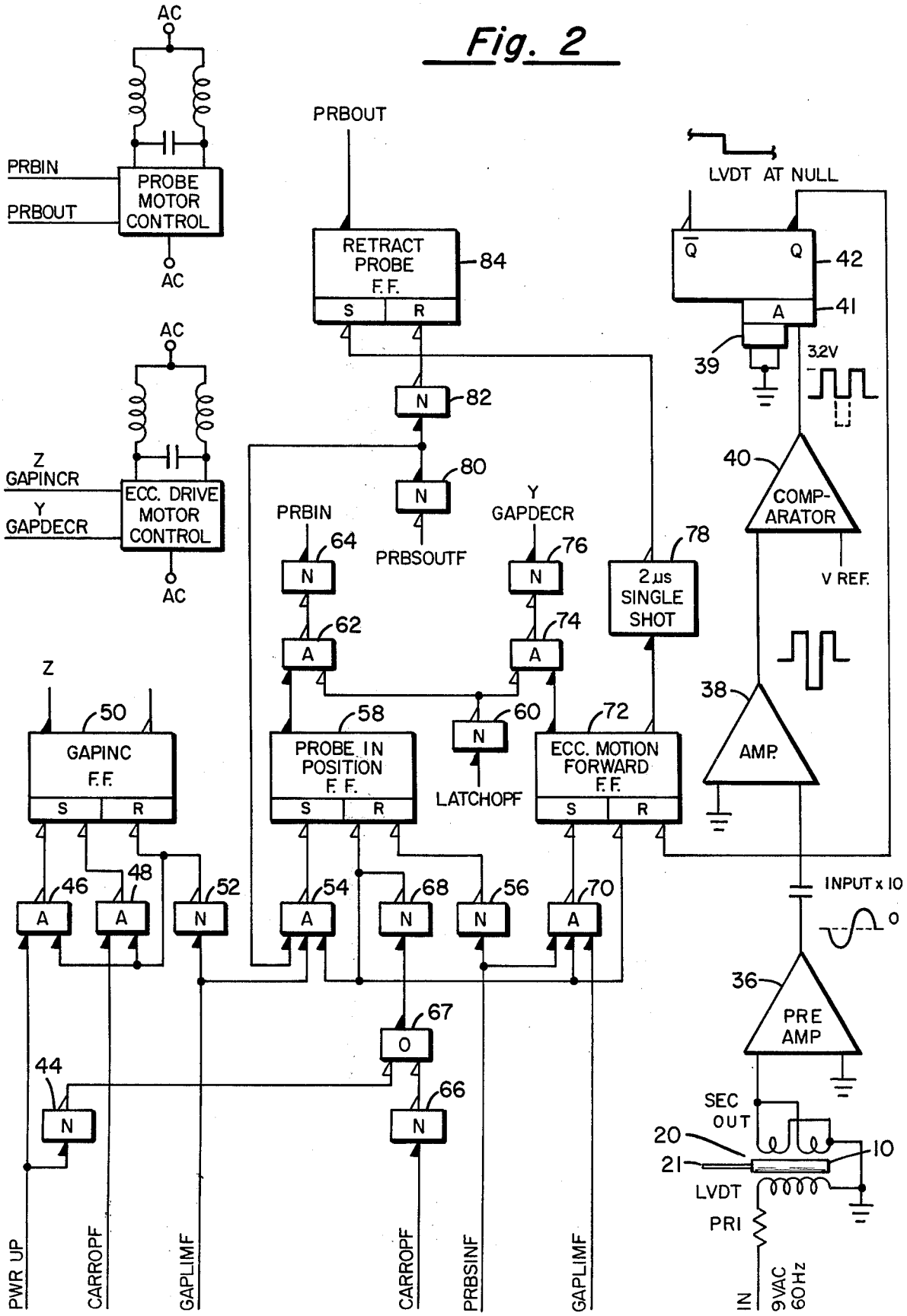
FIG. 2 shows the logical circuitry utilized in conjunction with the mechanical arrangement in FIG. 1 for developing the automatic print gap adjustment.

Referring now to FIG. 2, the logical circuitry for developing the cycles of operation discussed above is shown. For the sake of discussion, let us assume that the sequence of operation begins with an initial power-up sequence. A positive power-up (PWR-UP) signal is first generated in the printer which is applied directly to the AND GATE 46 as well as to the inverter 44. The second positive signal applied to the AND GATE 46 originates from the GAPLIMF (gap limit) signal. This signal is generated by a switch that is activated when the print gap is increased to its maximum (i.e., the eccentric is driven fully in the reverse direction). This signal is presumed to be low (L) since it is assumed that the carriage is not driven to its fully reverse direction. Accordingly the output of the inverter 52 is high (H) and since both inputs to the AND GATE 46 are now H its output will be L. This L signal is applied to the set (S) terminal of the flip-flop 50 so that the GAPINCR (gap increase) is H. The GAPINCR signal is applied to the eccentric drive motor control terminal causing the motor winding to rotate in a direction which causes the gap between the print head 10 and the print band 18 to increase until terminated.

Figure 3:
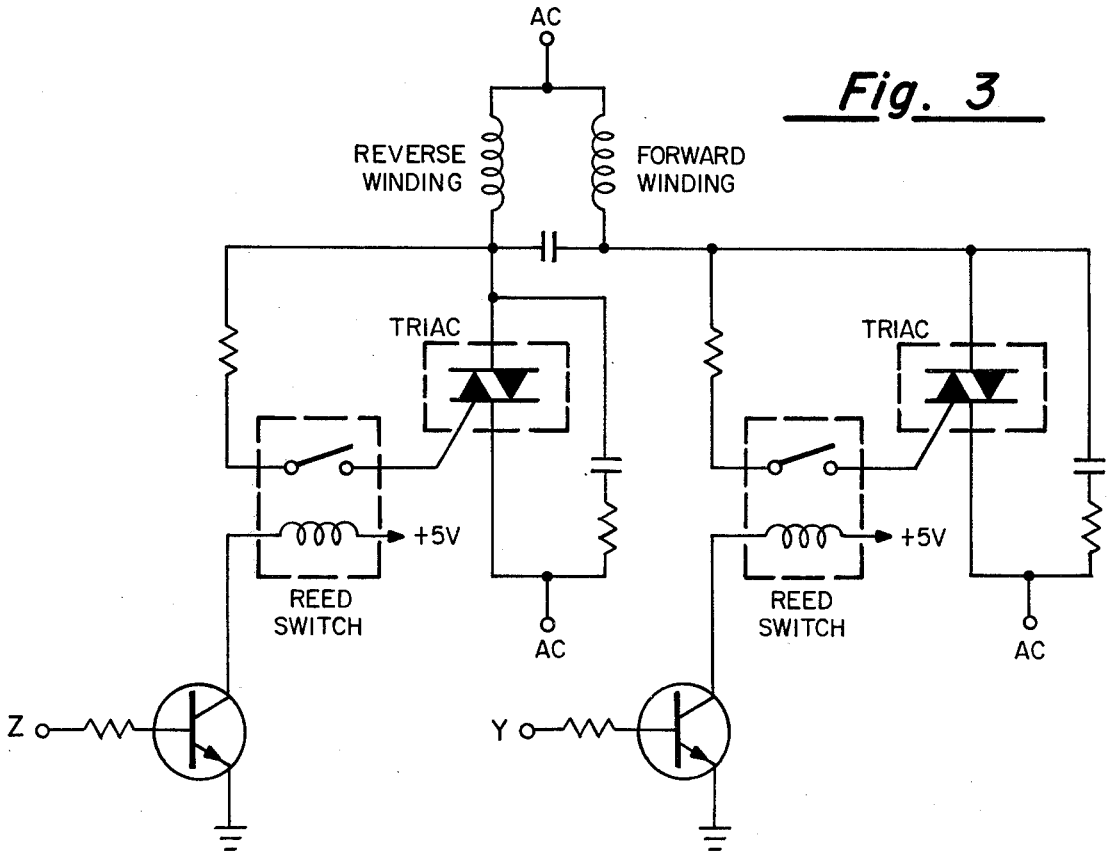
FIG. 3 is a schematic of the probe and eccentric drive motor control circuit.

FIG. 3 depicts the eccentric drive motor and its associated control circuitry. The motor is essentially a split phase motor and the control circuitry comprises a triac element, a reed switch and a $T^2L$ circuit. When a positive GAPINCR signal is applied to the base element of the $T^2L$ logic circuit, a current is conducted from the +5 volts source, through the coil of the reed switch and through the collector-emitter junction of the $T^2L$ circuit to ground. This current causes the contacts of the reed switch to close so that current is allowed to flow through the gate element of the triac. The current through the gate element causes the triac to conduct and, therefore, the AC circuit is completed so that the appropriate winding of the split phase motor is energized and the eccentric is driven in the reverse direction to increase the gap between the print head 10 and the print band 13.

The GAPINCR signal is terminated when the gap is made as large as possible and the eccentric is driven fully in the reverse direction. This occurs when the maximum gap limit switch (not shown) is activated and the GAPLIMF signal is produced thereby. The GAPLIMF signal when activated by the limit switch is applied to the inverter 52 and its negative output is applied to the AND GATE 46 as well as to the reset (R) terminal of the flip-flop 50. Since one of the inputs of the AND GATE 46 is now negative its output will be positive and will be applied as such to the S side of the flip-flop 50. In similar manner, the output of AND GATE 48 is positive and the CARROPF (carriage open) signal is negative. The CARROPF signal is positive only when the main carriage 24 on the sub-carriage 28 is opened. Therefore, since both inputs to the S terminal of flip-flop 50 are positive and its R terminal has a negative signal applied thereto the flip-flop will revert to the reset condition and the GAPINCR signal will become negative. The negative GAPINCR signal is applied to the base of the eccentric motor control $T^2L$ circuit causing it to stop conducting. The non-conduction of the transistor causes the reed switch and the triac gate circuit to open which in turn causes the triac to open and the AC circuit to no longer conduct through the eccentric motor reverse winding. Therefore, the eccentric motor stops running.

After the eccentric drive control has caused the eccentric to move the sub-carriage 28 so that the gap between the print head 10 and the print band 18 is as large as possible, the next sequence of operation is to cause the probe 21, which is coupled to the LVDT, to be driven until it is fully extended. This is accomplished in the following manner. The GAPLIMF signal which is positive when the carriage is driven fully in a reverse direction is also applied as such to the AND GATE 54. The second positive pulse applied to the AND GATE 54 is derived from the CARROPF signal. As stated previously, the CARROPF signal is H when the sub-carriage is open, but in the cycle under discussion (i.e., the sub-carriage is closed) the CARROPF signal will be L as applied to the input of the inverter 66. Since the input of the inverter 66 is L its output will be H as applied to the OR GATE 67. The second input to the OR GATE 67 is initiated by the PWR-UP signal. The PWR-UP signal is generated only when the machine power is first turned on after which it reverts to the L state. Therefore, the L output applied to the inverter 44 becomes H so that either input to the OR GATE 67 is H and its output is L. This L signal is applied to the inverter 68 so that its output is H as applied to the second input of the AND GATE 54. The third H input to the AND GATE 54 originates from the L PRBSOUTF (probe fully retracted) signal, which is applied to the input of the inverter 80. When the probe 21 is fully retracted, the PRBSOUTF signal is L.

Since all three inputs to AND GATE 54 are now H its output goes L as applied to the S terminal of the flip-flop 58. At this time, the two inputs shown to the R terminal of the flip-flop 58 are both H. One input is H in view of the PRBSINF (probe fully in position) signal, which is L, being applied to the inverter 56. The PRBSINF signal is generated by a switch 90 (FIG. 4*a* + *b*) that is activated to the H voltage level when the probe is fully extended. Since the probe is not extended at this point in time, it may be appreciated that the PRBSINF signal is L and, therefore, the output of the inverter 56 is H. The second input to the R terminal of flip-flop 58 is H for the reason that the second input to the AND GATE 54 is H as previously discussed.

The L input signal applied to the S terminal and the two H signals applied to the R terminal of flip-flop 58 cause the latter to be set so that its output is H. This H signal is applied as an input to the AND GATE 62. The second input to the AND GATE 62 results from the LATCHOPF (latch open) signal, which is applied to the inverter 60. The LATCHOFF signal is L if the carriage latch is not open, which is assumed in the instant discussion. Accordingly, the output of the inverter 60 will be H so that both inputs to the AND GATE 62 are H. Accordingly, the output of the AND GATE 62 is L and is applied to the inverter 64 so that the PRBIN (probe to be driven) signal is H. The PRBIN signal activates the probe drive motor control causing the probe to be driven until it is fully extended against the forms pack 12.

When the probe 21 is in position or fully extended the PRBSINF signal will be generated. The PRBSINF signal is generated by a switch that is activated when the probe is fully extended and under this condition the PRBSINF signal is H. The inverter 56 changes the H voltage to a L voltage and is applied as an input to the R terminal of the flip-flop 58 so that the latter is reset. The output of the flip-flop 58 is therefore L when applied to the AND GATE 62. Since one of the inputs of the AND GATE 62 is now L its output will revert to a H state and will be altered by the inverter 64 to a L signal. This L signal causes the probe motor control to inactivate the probe drive motor.

In summary, the sequence of the logic circuitry has provided that the sub-carriage 28 has been fully retracted so as to provide a maximum distance between the print head 10 and the print band 18, and the probe 21 has been fully extended towards the forms pack 12.

As will be recalled the GAPLIMF signal is H when the print gap between the print head 10 and the print band 18 is increased to its maximum. The GAPLIMF signal is, therefore, applied as one of the three H inputs to the AND GATE 70. Another H signal to the AND GATE 70 results from the PRBSINF signal, which is produced when the probe is fully extended. The third H input to the AND GATE 70 emanates at the output of the inverter 68. It will be recalled that the CARROPF signal is L at this point in the cycle since it is assumed that the carriage is not open. Therefore the output of the inverter 66 is H as applied to the OR GATE 67. Since the second input to the OR GATE is H because the PWR-UP signal is now L the output of the OR GATE 67 will be L and accordingly the output of the inverter 68 is H.

The three H inputs to the AND GATE 70 causes its output to be L and cause the eccentric motion forward flip-flop 72 to be set. This H output signal is applied as one of the two inputs to the AND GATE 74. The second H input signal to the AND GATE 74 originates with the LATCH OFF signal to the inverter 60. It will be recalled that the LATCH OFF signal is L since it is assumed that the carriage latch is not opened. Therefore, the output of the inverter 60 is H. Since both inputs to the AND GATE 74 are H its output is L and this is inverted to a H signal identified as GAPDECR (gap decrease). The GAPDECR signal is applied to the eccentric drive motor control circuitry of FIG. 3 so as to cause the eccentric motor to rotate to begin to decrease the distance between the print head 10 and the print band 18. In other words, the sub-carriage 28 is caused to move in a leftward direction by means of the rotation of the eccentric.

Referring again to FIG. 1 it can be seen that as the eccentric 22 begins to rotate counterclockwise it causes the eccentric saddle follower 30 to move in a leftward direction so as to cause the sub-carriage 28 to likewise move in this direction. As the sub-carriage 28 is moved towards the left by the eccentric, the LVDT transformer body of the LVDT 20 containing the primary and secondary windings, which are mounted within the probe assembly, is similarly moved forward. When the core of the LVDT lines up with the center of the transformer body then alignment or a null condition is achieved and the eccentric motion is stopped. The eccentric stops the sub-carriage at the desired separation between the print head 10 and the print band 18. The stopping action occurs as follows.

A 9 volt AC, 60 HERTZ signal is applied to the primary winding of the LVDT 20. When a non-null condition is present in the LVDT, (i.e., the core 15 is not aligned within the windings) a sine wave output having a period of 16.7 milliseconds is produced and is applied to one of the inputs of the operational amplifier 36. The second input to the amplifier 36 is grounded. The output of the amplifier 36 is essentially a sine wave output, which has been amplified by a factor of ten, and is coupled by a capacitor into the input terminal of the amplifier 38. The amplified sine wave produced at the output of amplifier 36 is further amplified and clipped by the operational amplifier 38 to form a square wave output. The comparator 40 is $T^2L$ circuit utilized for detecting and coupling the analog signals produced by circuits 36 and 38 to the digital circuit 41 and 42. In the instant embodiment the voltage reference applied to one of the comparator 40 inputs is approximately 0.7 volts. Consequently, when the second input to the comparator 40 is equal to or less than 0.7 volts its output will be 0. In other words, a signal will not be present at the output of comparator 40 as applied to the input of the AND GATE 41 when the LVDT is at a null position. When the input to the comparator 40 exceeds 0.7 volts a square wave output will be produced that extends from 0 to 3.2 volts with a period of 16.7 milliseconds.

Accordingly, when the LVDT is not at a null position a positive voltage pulse will be applied to the AND GATE 41. In other words, the comparator 40 will produce a signal of sufficient amplitude to activate the digital circuit 41 when the LVDT is not nulled. A second input to the AND GATE is produced by the ground connection which is applied after inversion and gating by the OR GATE 39. Therefore, when the L inputs to the AND GATE 41 are positive it triggers the retriggerable delay flop 42. The pulse width of the delay flop is 18 microseconds. The output of the retriggerable delay flop 42 is applied to the R terminal of the flip-flop 72. This H signal will have no effect on the flip-flop 72 and, therefore, the GAPDECR signal applied to the eccentric drive motor control will continue to cause the eccentric to move in a direction to decrease the distance between the print head 10 and the print band 18.

Let us now assume that the automatic adjust mechanism has reached the proper gap distance. Since the output of the comparator 40 will now be L as applied to the AND GATE 41 the delay flop 42 will not be retriggered and its output will go L. This L output is applied to the R terminal of the flip-flop 72 so that the latter is reset. The output of the flip-flop 72 being reset will cause the second input to the AND GATE 74 to go L and its input to go H. After inversion by the inverter 76 the GAPDECR signal will be L as applied to the eccentric drive motor control. Consequently, the eccentric forward motion will stop and the distance between the print head 10 and the print band 18 will be at the desired separation.

When the flip-flop 72 is reset, its L output becomes H and is fed to the single-shot multivibrator 78. This H input signal applied to the multivibrator 78 causes its output to go L and sets the flip-flop 84. At this point in time, the PRBSOUTF signal is H since the probe is fully extended. Therefore, after inversion by the inverter 82 the signal applied to the R terminal or flip-flop 84 will be H. Accordingly, the L output of the single shot multivibrator 78 will cause the flip-flop 84 to be set so that the PRBOUT signal is H. This H signal activates the probe drive motor control causing the probe to be driven until it is fully retracted. When the probe is fully retracted the PRBSOUTF signal is produced by a switch (not shown) that is activated when the probe is fully in its retracted position. This L signal remains L after a double inversion by the inverters 80 and 82 causing the flip-flop 84 to be reset and the PRBOUT signal to become L.

Figure 4A:
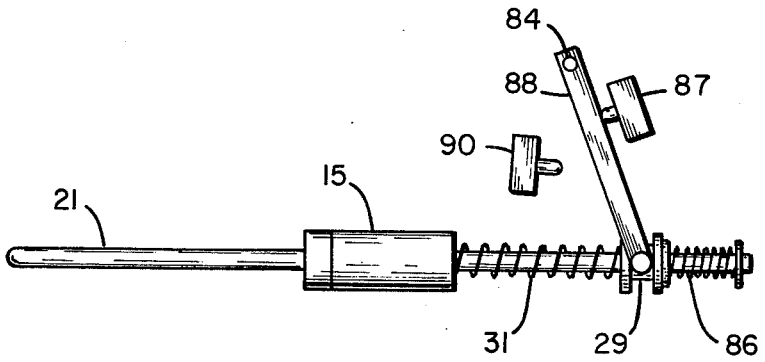
FIG. 4*a* and 4*b* illustrates the probe device utilized in the print hammer simulation cycle.
Figure 4B:
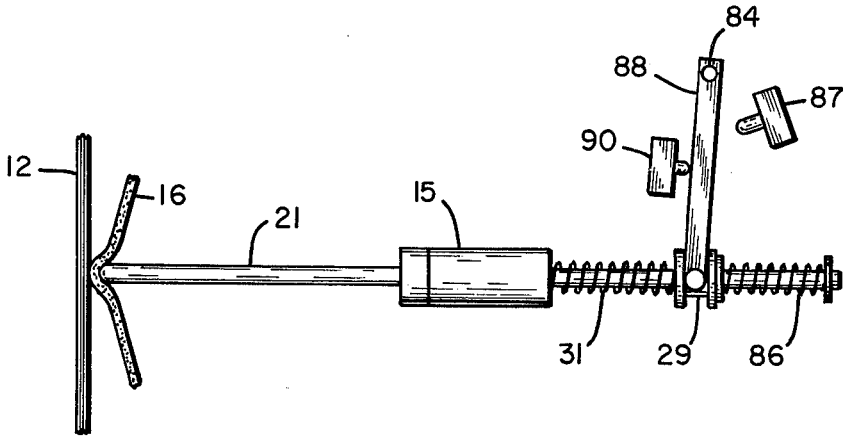

Referring now to FIG. 4*a* in greater detail, the probe 21 assembly is shown in the rest position before the simulation cycle begins. In the rest position, the forms load spring 31 is not compressed and the probe is retracted. While the probe is retracted the retraction spring 86 is loaded to insure positive retraction. When the PRBIN signal is applied to the probe motor control circuit (FIG. 3), the motor (not shown) through the motor shaft 84 and the probe arm 82 causes the probe 21 to extend until the probe limit switch 81 is contacted as shown in FIG. 4*b*. The activation of limit switch 90 causes the motor to stop and the retraction spring 86 will be unloaded and the forms spring 31 will be loaded.

The load on the forms load spring 31 will vary depending on the compressibility and thickness of the forms 12 and ribbon 16. The forms 12 may be a single or a multi-part form. If a multi-part form is being used it should be understood that the probe 21 will not be allowed to extend as far as if a single part form were being used. A multi-part form has a thickness of 0.020 inches and a single-part form a thickness of 0.003 inches. The ribbon thickness may vary between 0.003 to 0.005 inches. The variation that is sensed by the probe 21 is 0.019 inches. Therefore, the difference in the spring load 31 is proportionate to the difference in the forms thicknesses. In other words, the spring load is greater for a multi-part form than for a single part form since the spring 31 is compressed a greater distance in the former than in the second case. Accordingly, a larger spring force is used to compensate for the air spaces that exist between the sheets of a multi-part form.

The size and shape of the end of the probe are chosen so that the compression of the forms under spring load by the probe is like the compression of the form under actual printing process. Therefore, the gap between the print hammer and print band provided automatically by this invention is made in accordance with a print hammer simulation or what the print hammer sees.

What is claimed is:

1. The method of determining in a printer assembly the optimum distance between print hammers and paper forms which includes a probe coupled to a linear variable differential transformer comprising the steps of, a. extending said probe against said forms to thereby deform said paper, said probe extension causing a signal to be generated by said transformer indicative of the thickness of said forms;

b. altering the gap between said print hammers and forms to obtain said optimum distance by nulling said signal produced by said transformer;

c. withdrawing said probe from the extended position.

2. The method of determining in a digital printer assembly having print hammers and band utilizing both plural or in the alternative single-part forms the optimum distance between the print hammers which are located on a fixed main carriage and the ribbon and print band which are located on a moveable subcarriage comprising the steps of:

a. re-positioning the subcarriage in a horizontal direction away from said main carriage in order to obtain maximum separation between said fixed and moveable carriage;

b. compressing said forms with a probe to generate an electrical signal whose amplitude indicates the thickness of said forms;

c. positioning said subcarriage in proximity to said main carriage in accordance with said signal generation in order to obtain the optimum gap between said print hammers and print band;

d. withdrawing said probe into a retracted position.

3. The method in accordance with claim 2 wherein the correct gap is automatically obtained when said printer assembly is initially energized.

4. The method in accordance with claim 2 wherein the optimum gap is automatically obtained when a ribbon is changed.

5. The method of determining in a printer assembly having a print hammer and band utilizing variable thickness forms and ribbon the optimum distance between the print hammer and the print band comprising the steps of, a. compressing said variable thickness form which generates electrical signals indicative of the thickness of said forms;

b. adjusting automatically the distance between said print hammer and said print band after said electrical signals have been generated.

6. The method in accordance with claim 5 wherein said compressing step comprises extending a probe having a tip which is shaped to compress said ribbon and forms under spring loading.

* * * * *